United States Patent [19]

Andersen

[11] 4,232,503

[45] Nov. 11, 1980

[54] MACHINE FOR AUTOMATICALLY FILLING CANS

[75] Inventor: Niels J. Andersen, Broby, Denmark

[73] Assignee: Cabinplant A/S, Haarby, Denmark

[21] Appl. No.: 18,740

[22] Filed: Mar. 8, 1979

[30] Foreign Application Priority Data

Mar. 16, 1978 [DK] Denmark ..... 1184/78

[51] Int. Cl.[3] ..... B65B 37/16; B65B 63/00

[52] U.S. Cl. ..... 53/517; 53/243

[58] Field of Search ..... 53/514, 519, 243

[56] References Cited

U.S. PATENT DOCUMENTS

| | | | |
|---|---|---|---|
| 3,343,337 | 9/1967 | Vacche | 53/243 X |
| 3,541,754 | 11/1970 | Gugler | 53/243 X |

FOREIGN PATENT DOCUMENTS

| | | |
|---|---|---|
| 67538 | 8/1948 | Denmark . |
| 1379216 | 10/1964 | France . |

*Primary Examiner*—Travis S. McGehee

*Attorney, Agent, or Firm*—Stevens, Davis, Miller & Mosher

[57] ABSTRACT

A machine for automatically filling cans, especially flat cans with substantially rectangular contour, with goods of elongated configuration which, in a filling station, are manually laid into a horizontally continuous row of receptacles open at their adjacent ends and mounted on the links of an endless conveyor chain. The machine includes a cutting device for dividing the piece of goods between the adjacent ends of each receptacle, for supplying the cans with their facing downward in continuous row to a location where the conveyor chain initiates a downward movement around a sprocketwheel. As the conveyor chain rotates about the sprocketwheel, the distance between the individual receptacles is increased enabling a can supplied by the guide device to be placed over and surrounding each receptacle, the contents of which falls down in the can at the bottom of the sprocketwheel.

6 Claims, 3 Drawing Figures

1
2
3
4
5
6
7
8
9
10
11
12
13
14
15
16

MACHINE FOR AUTOMATICALLY FILLING CANS

BACKGROUND OF THE INVENTION

1. Field of the Invention

The present invention relates to a machine for automatically filling cans, especially flat cans with substantially rectangular contour. Filling of cans is generally performed by direct filling of goods into the cans, which are forwarded through the filling station with their openings facing upward by a conveyor means. When the cans are filled with goods of elongated configuration having a length which is greater than the length of the cans, as for example mackerel-fillets, it is necessary to first cut up the goods in pieces having a length which does not exceed that of the can which, of course, makes the filling operation more laborous.

2. Description of the Prior Art

Danish Pat. No. 67 538 describes a method of forming fillets of fish in blocs to be pushed into a carton for deep-freezing by laying the fillets in a groove moving in longitudinal direction to form a string, which is cut transversely into blocs of a desired length. Furthermore, French patent 1 379 216 describes a machine for packaging fruits by placing the same in corresponding openings in trays mounted on a horizontal chain-conveyor with some mutual distance, so that boxes especially adapted for packaging of the fruit can be placed over the trays, enabling the pieces of fruit, when the trays and the boxes have passed the sprocketwheel at the end of the conveyor, a fall down in predetermined cavities in the boxes.

SUMMARY OF THE INVENTION.

It is therefore an object of this invention to provide a machine for packing elongated pieces of foodware, especially fillets of fish in cans, the length of which may generally be shorter than that of the goods in question, the machine comprising a chain-conveyor running substantially horizontally through a filling station, where the goods for example fillets of mackerel are filled in a continuous row of receptacles, which are open at their adjacent ends and separately mounted on the links of said chain, and cutting means arranged for following the movement of the conveyor-chain and cutting through the goods at the interstices between the receptacles. According to the invention the machine is provided with guiding means supplying a continuous row of cans with their opening facing downward to the spot where the conveyor-chain initiates a downward movement around the sprocketwheel at the end of the conveyor, whereby the distance between the receptacles is increased so that the cans will be successively automatically caught by the receptacles and forced down to surround the same enabling the contents of each receptacle when passing the bottom of the sprocketwheel to fall down into the can.

After having passed the sprocketwheel the conveyor-chain with the receptacles, by appropriate means, is forced to move slightly upward, whereas the cans are moved away from the sprocketwheel in a horizontal direction, so that by the force of gravity the cans together with the goods in question will depart from the receptacles. At the bottom of the sprocketwheel on each side of the receptacles shuffles are mounted engaging the top of the cans to ensure that the cans under any conditions will depart from the receptacles.

Furthermore, to ensure that the goods will not adhere to the receptacle when it has been turned upside down around the sprocketwheel, each receptacle may, according to the invention, be provided with pushers arranged to be pushed through apertures in the bottom of the receptacle when it is passing by the lower part of the sprocketwheel. This pusher may for example consists of one or more flat springs mounted outside on the bottom of the receptacle and with its free ends bent so as to move through the aperture in the bottom.

Alternatively, a vibrator may be arranged adjacent the lower part of the sprocketwheel, so as to apply to the receptacles passing said part of the sprocketwheel a substantially vertical vibrating movement.

When using the machine for packing fillets of pickled herring, i.e. fillets cut into pieces which are shorter than the length of the can, the cutting device may comprise a number of parallel cutting means arranged to be forwarded through a corresponding number of slits in the sidewalls of the receptacle.

DESCRIPTION OF THE PREFERRED EMBODIMENTS

Figures 1, 2, 3:
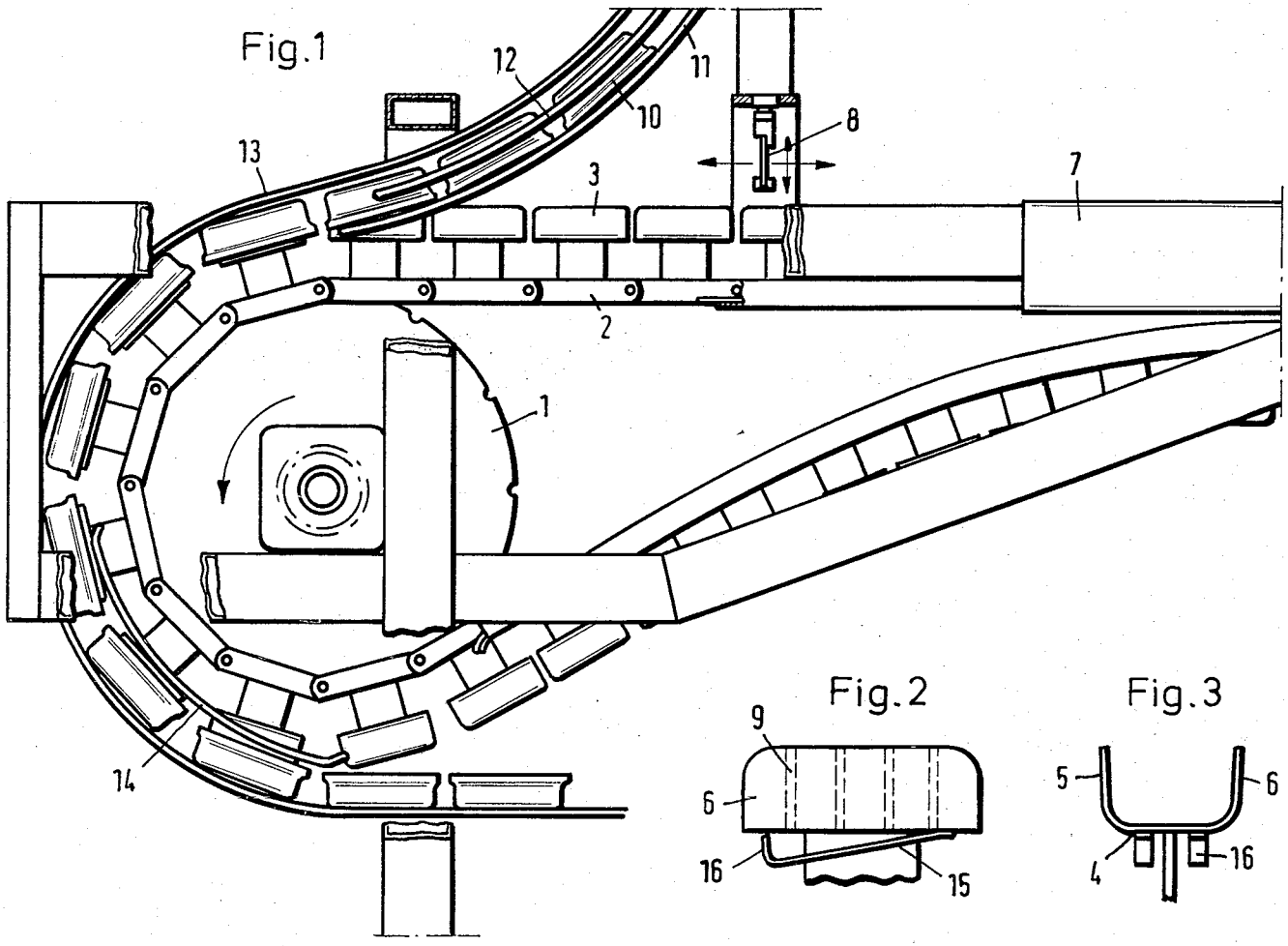
FIG. 1 is a schematic sideview of the part of a machine according to the invention, FIG. 2 a sideview of the receptacle and FIG. 3 an endview of the same.

The part of the machine according to the invention shown in the drawing comprises a sprocketwheel 1 rotating continuously in the direction indicated by the arrow, and acting on an endless chain 2. On the outer side of each link of the chain is mounted a receptacle 3 described below, placed in such distance from the links that their mutual distance will be increased when the chain is passing the sprocketwheel 1.

Each receptacle 3 consists as shown in FIGS. 2 and 3 of a bottom 4 and two sidewalls 5 and 6 but without endwalls, so that the receptacles when the chain is moving in a rectlinear path as for example through the filling station 7, of which the last part is shown in FIG. 1, will form a groove wherein it is possible in the filling station to lay down the goods without considering whether their length is greater than that of the single cans, as for example generally will be the case with fillets of mackerel.

In view of this, following the filling station 7 in the moving direction of the conveyor-chain is provided a cutting device 8, which in a way known per see and not shown in the drawing is automatically forwarded between adjacent ends of the receptacle 3 to cut the loaded goods, whereby the cutting device is arranged during this operation to follow the forward movement of the receptacles and after having finished the cutting operation to return to its initial position.

Provided that the machine will be used for packaging of goods to be delivered with a length which is only a fraction of that of the can, for example fillets of pickled herring, it will be possible by the machine according to the invention to place the full length of the herring fillets in the groove formed by the successive receptacles in the filling station, whereafter the cutting of the fillets is performed automatically, as the machine according to the invention, in addition to the cutting means 8, is provided with a desired number of parallel cutting means, for example a number of parallel rotating knives which are forwarded transversely through each receptacle, the sidewalls of which are provided with a corresponding number of slits 9, as shown with dotted lines in FIG. 2. These cutting devices are in the same way as the cutting device 8 arranged to following the forward movement of the receptacle 3 in question during the cutting operation.

The cans 10, dimensioned corresponding to the receptacle 3, so that with a convenient clearance they may be led down on the receptacle, are delivered individually from a magazine, not shown in the drawing, to conveyor-means consisting of guiding rails 11–13, which as shown may consist of rails 11 supporting the cans and siderails 12 guiding the cans in transverse direction, and rails 13 positioned over the cans to support them during the last part of the movement around the sprocketwheel 1.

The rails 11–13 guide the cans 10 in an inclined downward direction to the place where the links of the chains 2 in contact with the sprocketwheel 1 initiate their turning movement so that the receptacle may catch a can from the guiding rails turning the can to a position, where it completely surrounds the receptacle, and the following receptacle will then move into and catch the next can resting on the guiding rails.

By moving around the sprocketwheel 1 the receptacles with the cans placed thereon will turn around so that the receptacles at the lower part of the sprocketwheel have their opening facing downward and the cans have their opening facing upward. From this lower position the chain with the receptacle mounted thereon is by adequate provisions moving in a slightly upward direction so that the receptacle will move up from the cans, which from this lower position are forwarded in a horizontal path. Simultaneously, the contents of the receptacle will by the force of gravity be transferred to the respective cans.

To ensure that the cans under the last part of the said turning movement under any conditions are disengaged from the receptacles, shuffles 14 are placed on each side of the path of the cans to engage the edges of same.

Furthermore, to ensure that the contents of the receptacles during the last part of the turning movement under any conditions will fall down in the cans, the receptacles are preferably provided with pushing means, which for example as shown in FIGS. 2 and 3 consist of two flat springs 15 which at their one end are mounted on the outer side of the bottom 4, and the opposite end has a turndown part 16 which, when acting on the spring 15, is led through corresponding apertures in the bottom 4. This movement may be achieved by adequate cams not shown in the drawing positioned below the sprocketwheel 1. Alternatively, a vibrator may be positioned at that place so as to transfer a substantially vertical vibration to the receptacles. After turning and transferring of the goods to the cans, they are by adequate means transferred for further operations as for example supplying of pickle, heat treatment, sterilization and attaching of the lid. This further operation, however, has no relation to the present invention, and the same is the case of the provisions for continuous cleaning of the receptacles between each filling operation, and the description of this part of the machine is therefore omitted.

What is claimed is:

1. A machine for automatically filling elongated pieces of food-ware in cans, comprising a substantially horizontal endless conveyor chain rotating about a sprocketwheel, each link of said chain carrying a receptacle, each said receptacle being open at its top and at its opposite ends, the outer dimensions of each said receptacle substantially corresponding to the inside dimension of said cans, successive receptacles being lengthwise aligned to form a groove at least through a filling station through which said chain passes; a cutting device arranged to be moved between the adjacent ends of the receptacles; and guiding means for supplying a continuous row of cans having openings facing downward to a location where said conveyor chain initiates a downward movement as it rotates around said sprocketwheel, said conveyor chain and guiding means approaching one another at said sprocketwheel so that cans from said guiding means are successively caught by respective receptacles and forced down to surround the same and be retained in this position to the lower part of said sprocketwheel.

2. A machine as defined in claim 1, wherein:

shuffles are provided for pushing on the edges said cans as they pass the lower part of the sprocketwheel to ensure removal of said cans from said receptacles.

3. A machine as defined in claim 1, wherein: each receptacle is provided with pusher means arranged to push through corresponding apertures in the bottom of the receptacle.

4. A machine as defined in claim 2, wherein:

said pusher means comprises one or more flat springs mounted outside on the bottom of an associated receptacle, said flat springs having a free end bent so as to be moved through the aperture in the bottom of the receptacle.

5. A machine as defined in claim 1, wherein: adjacent the lower part of the sprocketwheel a vibrator is arranged so as to apply a substantially vertical vibrating movement to the passing receptacles.

6. A machine as defined in claim 1, wherein: said cutting device includes a number of parallel cutting means arranged to be moved through a corresponding number of slits in the sidewalls of the receptacles.

* * * * *